US008491224B2

(12) United States Patent
Cobb et al.

(10) Patent No.: US 8,491,224 B2
(45) Date of Patent: Jul. 23, 2013

(54) PLASTIC DETENTION CHAMBER FOR STORMWATER RUNOFF AND RELATED SYSTEM AND METHODS

(75) Inventors: Daniel P. Cobb, Gray, ME (US); Michael P. Stone, Falmouth, ME (US); James C. Schluter, Franklin, OH (US); Michael G. Katona, Gig Harbor, WA (US); Roger L. Brockenbrough, Pittsburgh, PA (US)

(73) Assignee: Contech Engineered Solutions LLC, West Chester, OH (US)

( * ) Notice: Subject to any disclaimer, the term of this patent is extended or adjusted under 35 U.S.C. 154(b) by 977 days.

(21) Appl. No.: 12/370,287

(22) Filed: Feb. 12, 2009

(65) Prior Publication Data

US 2009/0220302 A1 Sep. 3, 2009

Related U.S. Application Data

(60) Provisional application No. 61/028,304, filed on Feb. 13, 2008.

(51) Int. Cl.
*E02B 11/00* (2006.01)
*E02B 13/00* (2006.01)

(52) U.S. Cl.
USPC ..... 405/49

(58) Field of Classification Search
USPC ..... 405/38–49
See application file for complete search history.

(56) References Cited

U.S. PATENT DOCUMENTS

| | | | | |
|---|---|---|---|---|
| 2,126,870 | A | | 8/1938 | Carswell et al. |
| 3,789,615 | A | * | 2/1974 | Maroschak ..... 405/49 |
| 4,759,661 | A | | 7/1988 | Nichols et al. |
| 5,017,041 | A | | 5/1991 | Nichols |
| 5,078,589 | A | | 1/1992 | Osuna-Diaz |
| 5,087,151 | A | | 2/1992 | DiTullio |
| 5,156,488 | A | | 10/1992 | Nichols |
| 5,336,017 | A | | 8/1994 | Nichols |
| 5,401,116 | A | | 3/1995 | Nichols |
| 5,401,459 | A | | 3/1995 | Nichols et al. |
| 5,419,838 | A | | 5/1995 | DiTullio |
| 5,441,363 | A | | 8/1995 | Gray |
| 5,511,903 | A | | 4/1996 | Nichols et al. |
| 5,573,038 | A | | 11/1996 | Kanao |
| 5,588,778 | A | | 12/1996 | Nichols et al. |
| 5,716,163 | A | | 2/1998 | Nichols et al. |
| 5,773,756 | A | | 6/1998 | DiTullio |
| 5,839,844 | A | | 11/1998 | Nichols et al. |
| 5,890,838 | A | | 4/1999 | Moore, Jr. et al. |
| 6,129,482 | A | | 10/2000 | Ditullio |

(Continued)

OTHER PUBLICATIONS

PCT, International Preliminary Report on Patentability, PCT/US2009/033899 (Aug. 26, 2010).

(Continued)

*Primary Examiner* — Sunil Singh
(74) *Attorney, Agent, or Firm* — Thompson Hine LLP

(57) ABSTRACT

A plastic, corrugated open bottom chamber includes features such as one or more of (i) sub-corrugation features on corrugation crests and/or corrugation valleys, (ii) stiffening fingers on the bottom of chamber foot portions, (iii) a viewport configuration that intersects only a single corrugation crest and (iv) a unitary end wall. A method of producing chambers with or without a unitary end wall using a common mold tool is also provided. A method of interconnecting chambers to form a chamber rows is also provided.

17 Claims, 17 Drawing Sheets

U.S. PATENT DOCUMENTS 6,322,288 B1 * 11/2001 DiTullio ..... 405/43
6,361,248 B1 3/2002 Maestro
D465,545 S 11/2002 Maestro
D469,187 S 1/2003 Maestro
6,602,023 B2 8/2003 Crescenzi et al.
6,612,777 B2 9/2003 Maestro
6,679,653 B1 1/2004 DiTullio
6,680,011 B2 1/2004 Moore, Jr. et al.
6,716,387 B2 4/2004 Thomas
6,719,490 B2 4/2004 Maestro
6,854,925 B2 2/2005 DiTullio
6,991,734 B1 1/2006 Smith et al.
6,994,355 B2 2/2006 Brochu et al.
6,994,490 B2 2/2006 Maestro
7,004,221 B2 2/2006 Moore, Jr. et al.
7,008,138 B2 3/2006 Burnes et al.
7,052,209 B1 5/2006 Kruger et al.
7,118,306 B2 10/2006 Kruger et al.
7,189,027 B2 3/2007 Brochu et al.
7,207,747 B1 4/2007 England
7,217,063 B2 5/2007 Moore, Jr. et al.
7,226,241 B2 6/2007 DiTullio
7,237,981 B1 7/2007 Vitarelli
7,273,330 B1 9/2007 Brochu et al.
7,300,226 B1 11/2007 Maestro
7,473,053 B1 * 1/2009 Brochu et al. ..... 405/49
2003/0219310 A1 11/2003 Burnes et al.
2005/0074286 A1 4/2005 Swistak et al.
2005/0074288 A1 4/2005 Moore, Jr.
2005/0238434 A1 10/2005 Coppes et al.
2006/0076714 A1 4/2006 Swistak et al.
2006/0138706 A1 6/2006 Brochu et al.
2006/0233612 A1 10/2006 DiTullio
2007/0077122 A1 4/2007 Birchler et al.
2007/0081860 A1 4/2007 Goddard et al.
2007/0154261 A1 7/2007 Brochu et al.
2007/0172314 A1 7/2007 Brochu et al.
2007/0231071 A1 10/2007 Brochu et al.
2010/0329788 A1 * 12/2010 Moore, Jr. ..... 405/49

OTHER PUBLICATIONS

International Search Report and Written Opinion, PCT/US2009/033899 (Apr. 21, 2009).

NZ, Examination Report, New Zealand Application No. 587430 (Sep. 23, 2011).

* cited by examiner

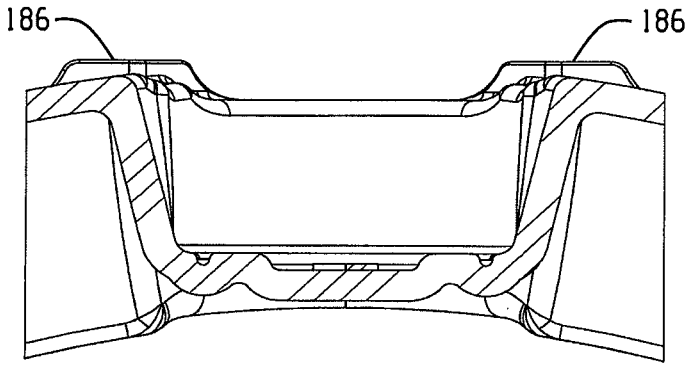
Fig. 26
Fig. 27
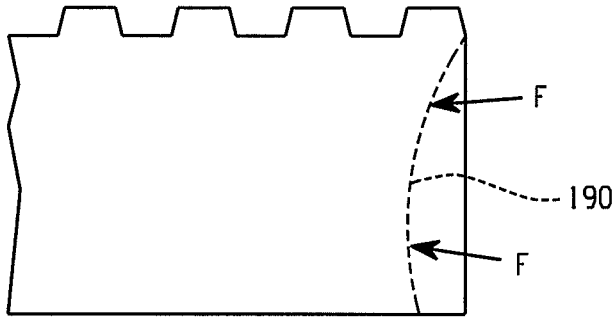
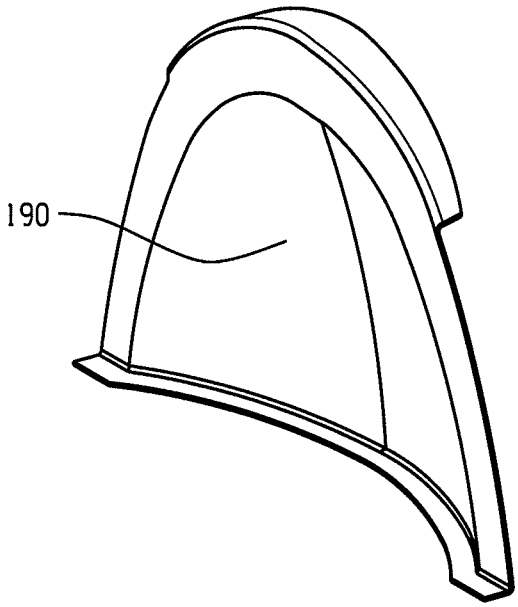
Fig. 28

PLASTIC DETENTION CHAMBER FOR STORMWATER RUNOFF AND RELATED SYSTEM AND METHODS

CROSS-REFERENCES

This application claims the benefit of U.S. Provisional Application Ser. No. 61/028,304, filed Feb. 13, 2008, the entirety of which is incorporated herein by reference.

TECHNICAL FIELD

This application relates generally to molded chambers for water detention and, more particularly to molded plastic chambers that are buried in the ground and receive stormwater runoff from developed sites.

BACKGROUND

Molded plastic detention chambers for burial in the earth for use in temporary stormwater detention are known. It would be desirable to provide an improved chamber and related system and method.

SUMMARY

In one aspect, an apparatus for receiving and dispersing water includes a plastic arch-shaped corrugated chamber having a generally open bottom and a plurality of corrugation crests and valleys distributed along a length of the chamber. The corrugation crests and valleys extend transverse to a lengthwise axis of the chamber. Each one of a multiplicity of the corrugation crests includes a respective crest sub-corrugation feature thereon.

Each one of a multiplicity of the corrugation valleys may include a valley sub-corrugation feature thereon.

Each crest sub-corrugation feature may be an external raised sub-corrugation feature and each valley sub-corrugation feature may be an external raised sub-corrugation feature.

Each crest sub-corrugation feature may be substantially centered along a width of its respective corrugation crest, and each valley sub-corrugation feature may be substantially centered along a width of its respective corrugation valley.

The chamber may include a first end corrugation crest at one chamber end and second end corrugation crest at an opposite chamber end, each of the first and second end corrugation crests lacking any sub-corrugation feature, and a first end corrugation valley adjacent the first end corrugation crest and a second end corrugation valley adjacent the second end corrugation crest, each of the first and second end corrugation valleys lacking any sub-corrugation feature.

Each crest sub-corrugation feature may be located along at least a top portion of its respective crest, and each crest sub-corrugation feature may have a crest sub-corrugation height, relative to its corrugation crest, that is less than 10% of a height of the corrugation crest relative to its adjacent corrugation valley. Each valley sub-corrugation feature located along at least a top portion of its respective valley, and each valley sub-corrugation feature may have a valley sub-corrugation height, relative to its corrugation valley, that is less than 10% of a height of the adjacent corrugation crest relative to the corrugation valley.

A width of each of the multiplicity of corrugation crests may be greater toward the bottom of the chamber than at a top of the chamber. A width of each crest sub-corrugation feature may be greater toward the bottom of the chamber than at the top of the chamber. A width of each of the multiplicity of corrugation valleys may be less toward the bottom of the chamber than at the top of the chamber. A width of each valley sub-corrugation feature may be less toward the bottom of the chamber than at the top of the chamber.

Each crest sub-corrugation feature may be located along at least a top portion of its respective corrugation crest, and each crest sub-corrugation feature may have a crest sub-corrugation height, relative to its corrugation crest, that is no more than about three times a thickness of the plastic defining the corrugation crest. Each valley sub-corrugation feature may located along at least a top portion of its respective corrugation valley, and each valley sub-corrugation feature may have a valley sub-corrugation height, relative to its corrugation valley, that is no more than about three times a thickness of the plastic defining the corrugation valley.

Each crest sub-corrugation feature may be located along at least a top portion of its respective crest, and each crest sub-corrugation feature may have a crest sub-corrugation height, relative to its corrugation crest, that is less than 10% of a height of the corrugation crest relative to its adjacent corrugation valley.

A width of each of the multiplicity of corrugation crests may be greater toward the bottom of the chamber than at a top of the chamber, and a width of each crest sub-corrugation feature may be greater toward the bottom of the chamber than at the top of the chamber.

Each crest sub-corrugation feature may be located along at least a top portion of its respective corrugation crest, and each crest sub-corrugation feature may have a crest sub-corrugation height, relative to its corrugation crest, that is no more than about three times a thickness of the plastic defining the corrugation crest.

Each crest sub-corrugation feature may have at least one opening therein, the opening located toward the bottom of the chamber and offset toward one side of the sub-corrugation feature.

The corrugation crests and valleys may extend from side to side of the chamber between spaced apart lengthwise extending foot portions of the chamber, wherein each foot portion includes a bottom portion with a plurality of downwardly facing stiffening fingers.

Each foot portion may include first and second end parts at opposite lengthwise ends of the chamber, and an intermediate part between the first and second end parts, the stiffening fingers located on the intermediate part, bottom surfaces of the first and second end parts being substantially planar.

At least one viewport structure may be provided on the chamber, the viewport structure configured to intersect only a single corrugation crest.

The single corrugation crest may connect to adjacent corrugation valleys via respective opposed webs, and the viewport structure may includes outer curved wall portions, each outer curved wall portion intersects and provides structural continuity between respective portions of one of the opposed webs.

At least one end of the chamber may include an inwardly domed end wall.

In another aspect, a method is provided for producing plastic arch-shaped corrugated chambers having generally open bottoms, including an end wall chamber type having at least one closed end with a unitary end wall, and a open chamber type having opposite ends that are both open. The method includes: providing a mold tool including a mold core part and a mold cavity part, when located in respective mold positions the mold core part and mold cavity part define a chamber end wall formation space at one end of a chamber body formation space; when producing the end wall chamber type, placing the mold core part and mold cavity part in the respective mold positions such that the chamber body formation space is in communication with the end wall formation space and injecting plastic into the mold tool such that plastic in the end wall formation space forms unitary with plastic in the chamber body formation space; and when producing the open chamber type, placing the mold core part and mold cavity part in the respective mold positions and injecting plastic into the mold tool, and providing a shutoff to prevent plastic flow from the chamber body formation space to the end wall formation space.

Providing the shutoff may involve placing at least one open chamber insert member within the mold tool, the at least one open chamber insert member blocking plastic flow from the chamber body formation space to the end wall formation space.

When producing the end wall chamber type, the method may include placing at least one end wall chamber insert member within the mold tool, the end wall chamber insert member sized to permit communication between the chamber body formation space and the end wall formation space.

When producing the end wall chamber type, the injecting may include injecting plastic directly into the end wall formation space, and the at least one end wall chamber insert member includes at least one sprue formation structure for producing a sprue on the end wall of the end wall chamber type.

When producing the open chamber type, the at least one open chamber insert member may include structure to block direct injection of plastic into the end wall formation space.

The at least one open chamber insert member may be secured to the mold core part.

The at least one open chamber insert member may be positioned along an intersection location of an end wall portion of the mold core part and a chamber body portion of the mold core part.

The end wall formation space may define a plurality of generally vertically extending end wall corrugation formation spaces and/or at least two end wall hand-hold formation spaces.

In another aspect, an apparatus for receiving and dispersing water includes plastic arch-shaped corrugated chamber having a generally open bottom and including a plurality of corrugation crests and valleys distributed along a length of the chamber, the corrugation crests and valleys extending from side to side of the chamber between spaced apart lengthwise extending foot portions of the chamber and transverse to a lengthwise axis of the chamber. Each foot portion includes a bottom portion with a plurality of downwardly facing stiffening fingers.

Each foot portion may extend laterally outward from lower ends of the corrugation crests and valleys, and the stiffening fingers of each foot portion may have lengthwise axes that extend from a lateral side edge of the foot portion toward the corrugation crests and valleys.

The stiffening fingers of each foot portion may terminate short of the corrugation valleys, and the bottom of each foot portion may be substantially planar in a valley region located between the corrugation crests. The top surface of the foot portion in the valley region may be recessed relative to the top surface of at least an intermediate lateral part the foot portion.

The stiffening fingers of each foot portion have thicknesses that extend downward from a continuous upper part of the foot portion.

The bottom surfaces of the stiffening fingers of each foot portion may lie in substantially the same plane.

Each foot portion may include first and second end parts at opposite lengthwise ends of the chamber, and an intermediate part between the first and second end parts, the stiffening fingers are located on the intermediate part, bottom surfaces of the first and second end parts are substantially planar.

The bottom surface of the first end part of each foot portion may be substantially co-planar with bottom surfaces of the stiffening fingers, and the bottom surface of the second end part of each foot portion may be elevated relative to the bottom surfaces of the stiffening fingers.

A top surface of the first end part of each foot portion may be recessed relative to a top surface of the intermediate part to facilitate overlap by the bottom surface of the second end part of another chamber.

When the spaced apart foot portions of the chamber support the chamber on a gravel or stone sub-base material, a spacing between the stiffening fingers of each foot portion may be smaller than a size of the gravel or stone so as to prevent the sub-base material from entering the spacing between the stiffening fingers, thereby providing a projected bearing surface for the foot portion that is substantially the same as if the bottom of the foot portion were planar.

The stiffening fingers of each foot portion may have a varying width that is narrower at lateral side edge of the foot portion than at the finger end located toward the corrugation crests and valleys.

Each foot portion may include first and second end parts at opposite lengthwise ends of the chamber, and an intermediate part between the first and second end parts, the stiffening fingers located on the intermediate part. The stiffening fingers of the intermediate part of each foot portion may have thicknesses that extend downward, the thickness of each stiffening finger being substantially the same as a thickness of the first and second end parts.

Each foot portion may include multiple lengthwise extending stacking blocks thereon.

Each stacking block may extend from one side of a corrugation crest toward an adjacent corrugation crest and may have a terminal end that stops short of the adjacent corrugation crest.

In a further aspect, an apparatus for receiving and dispersing water includes a plastic arch-shaped corrugated chamber having a generally open bottom and including a plurality of corrugation crests and valleys distributed along a length of the chamber, the corrugation crests and valleys extending transverse to a lengthwise axis of the chamber, wherein at least one viewport structure is provided on the chamber, the viewport structure configured to intersect only a single corrugation crest.

The single corrugation crest may connect to adjacent corrugation valleys via respective opposed webs, and the viewport structure may include outer curved wall portions, each outer curved wall portion intersects and provides structural continuity between respective portions of one of the opposed webs.

Each curved wall portion may include a top surface that connects with the single corrugation crest at each end of the curved wall portion, each end of the curved wall portion further including a raised stiffening ridge that extends onto the adjacent portion of the single corrugation crest.

In yet another aspect, a method is provided for interconnecting a series of a plastic arch-shaped corrugated chambers end to end to form an elongated chamber row. The method involves the steps of:

(a) providing first and second end wall chambers each having a closed end with a unitary end wall and an opposite open end having a small end corrugation;

(b) providing multiple open end chambers each having first and second open ends, the first end having a small end corrugation and the second end having a end corrugation that is larger than the small end corrugation;

(c) placing the first end wall chamber in a first lengthwise orientation;

(d) connecting a first open end chamber to the first end wall chamber by overlapping the small end corrugation of the first end wall chamber with the end corrugation at the second end of the first open end chamber;

(e) connecting one or more additional open end chambers in the chamber row by overlapping the small end corrugation of each open end chamber with the end corrugation at the second end of a next open end chamber;

(f) connecting the second end wall chamber to a last open end chamber of the chamber row by either:

(i) cutting the last open end chamber of the chamber row to remove at least its small end corrugation, and placing the second end wall chamber in a lengthwise orientation that is opposite the lengthwise orientation of the first end wall chamber, and overlapping the small end corrugation of the second end wall chamber with an intermediate corrugation of the last open end chamber; or (ii) cutting the second end wall chamber to remove at least its small end corrugation, and placing the second end wall chamber in a lengthwise orientation that is opposite the lengthwise orientation of the first end wall chamber, and overlapping the small end corrugation of the last open end chamber of the chamber row with an intermediate corrugation of the second end wall chamber.

The cutting step of either (f)(i) or (f)(ii) may involve cutting to achieve a specified chamber row length.

In another aspect, an apparatus for receiving and dispersing water includes a plastic arch-shaped corrugated chamber having a generally open bottom and including a plurality of corrugation crests and valleys distributed along a length of the chamber, the corrugation crests and valleys extending transverse to a lengthwise axis of the chamber, wherein at least one end of the chamber includes an inwardly domed end wall.

When the chamber is buried and the inwardly domed end wall acts in membrane tension.

The inwardly domed end wall may be unitary with or formed separate from the chamber.

When formed separate from the chamber the unitary end wall may include a perimeter structure that externally overlaps with at least a portion of an end corrugation of the chamber.

The inwardly domed end wall may lack any ribs or corrugations.

BRIEF DESCRIPTION OF THE DRAWINGS

FIG. 26 shows a cross-section of the view port of FIG. 25 taken along line A-A;

FIGS. 27 and 28 show an alternative chamber arrangement and associated inwardly domed end wall.

DETAILED DESCRIPTION

Figure 1:
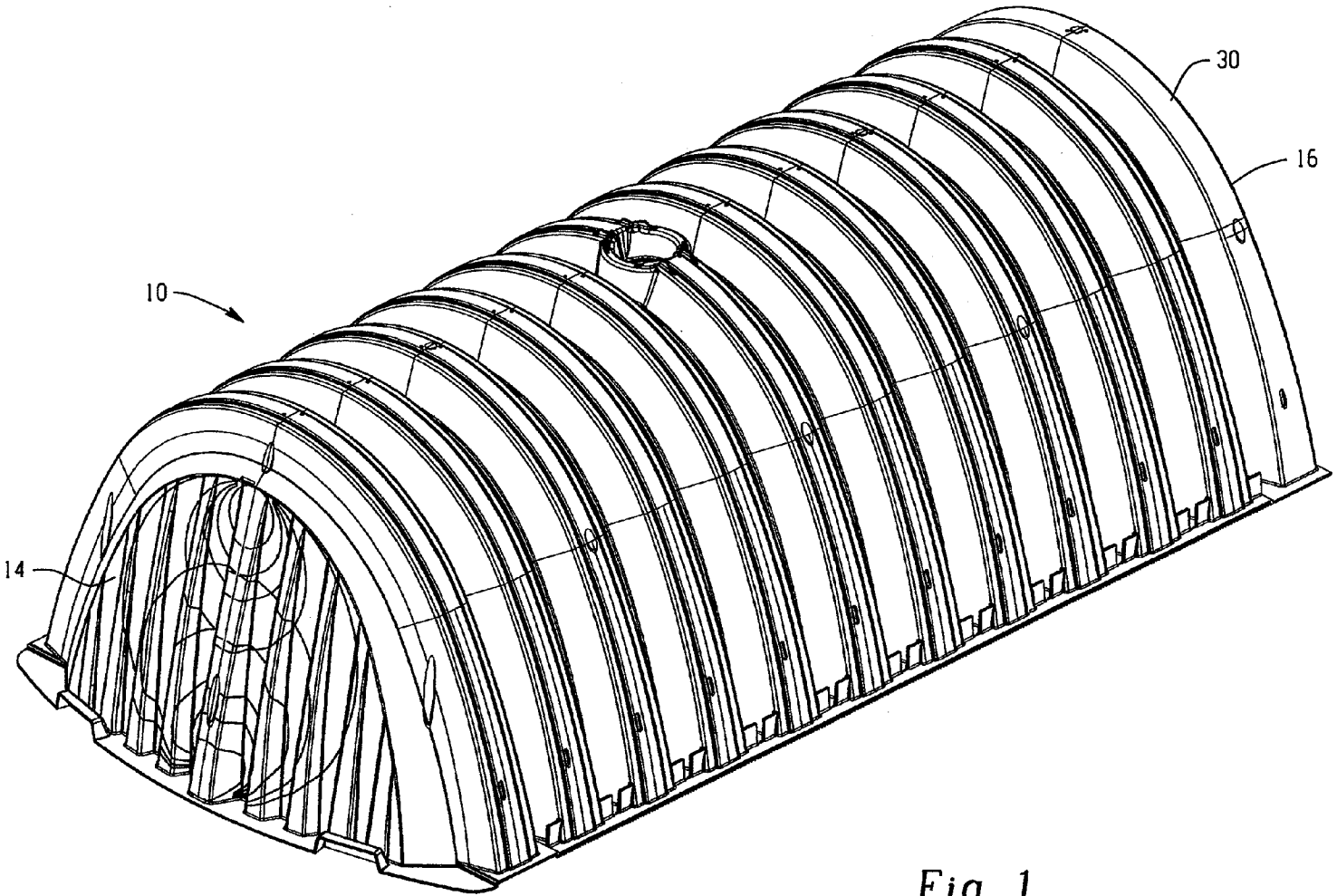
FIG. 1 shows a perspective of one embodiment of a chamber with a unitary end wall at one end.

Referring to FIGS. 1-4, perspective views and top plan views of two arch-shaped, corrugated plastic detention chambers 10 and 12 useful in connection with a buried stormwater detention system are shown. Chamber 10 is formed with an integral and unitary end wall 14 at one end and an opposite, open end 16. Chamber 12 is formed with two open ends 18 and 20. Each chamber includes respective spaced apart foot portions 22 and 24 (labeled only in FIGS. 2 and 4) and a plurality of arch-shaped corrugations 26 distributed along the length of the chamber and running substantially perpendicular to the lengthwise axis 28. As will be described in greater detail below, end corrugations 30, 32 are of a smaller size to allow overlap by, for example, the opposite end corrugation 34 of an adjacent chamber when a system of chambers is linked together. End corrugation 34 may also be different than the corrugations 26 extending between the ends.

Figure 5:
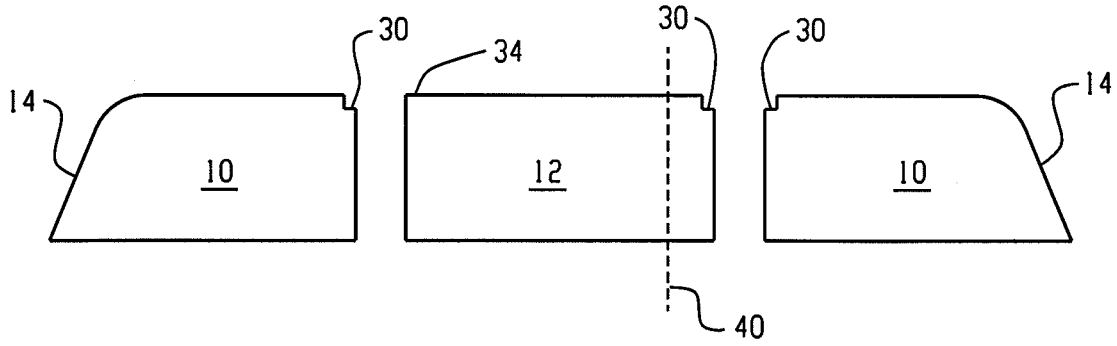
FIGS. 5 and 6 show schematic depictions for two possible chamber connecting configuration techniques.
Figure 6:
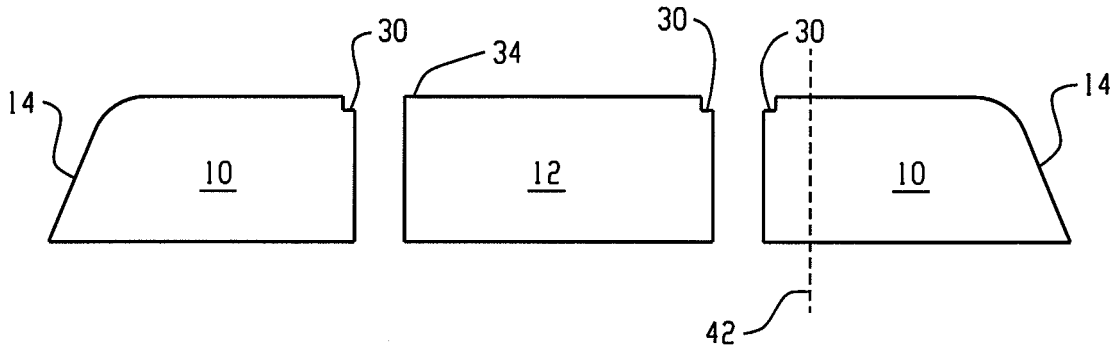
Figure 8:
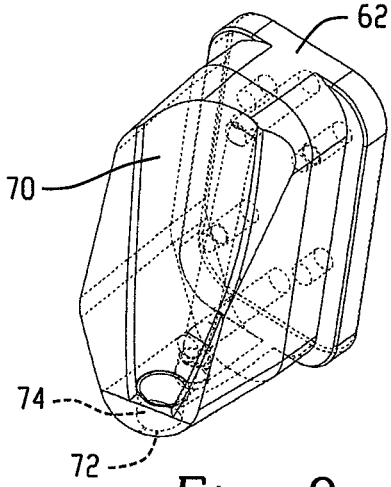
FIGS. 7-9 show mold tool insert embodiments for production of chambers having end walls.
Figure 9:
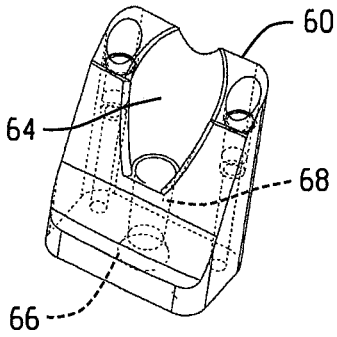
Figure 7:
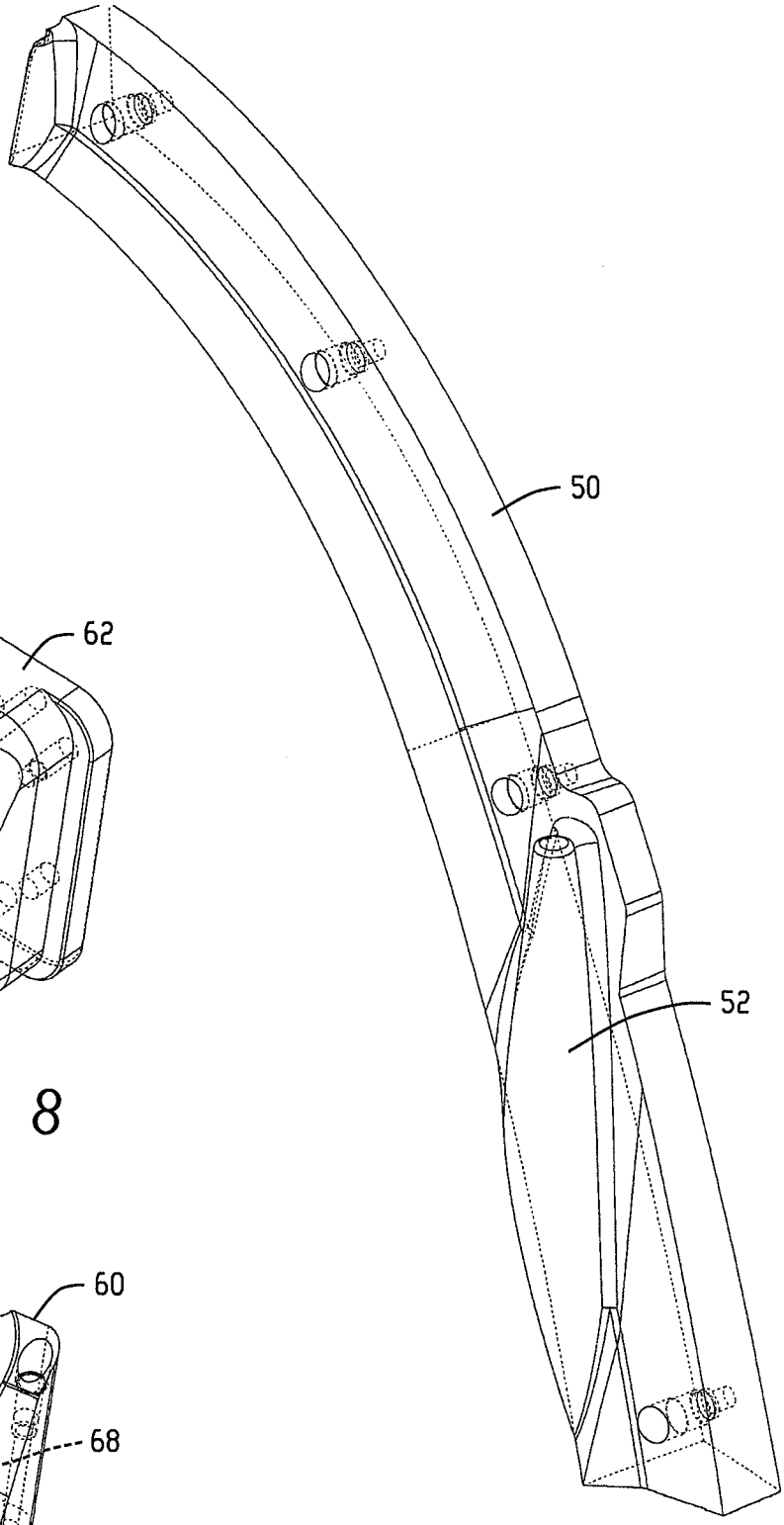
Figure 10:
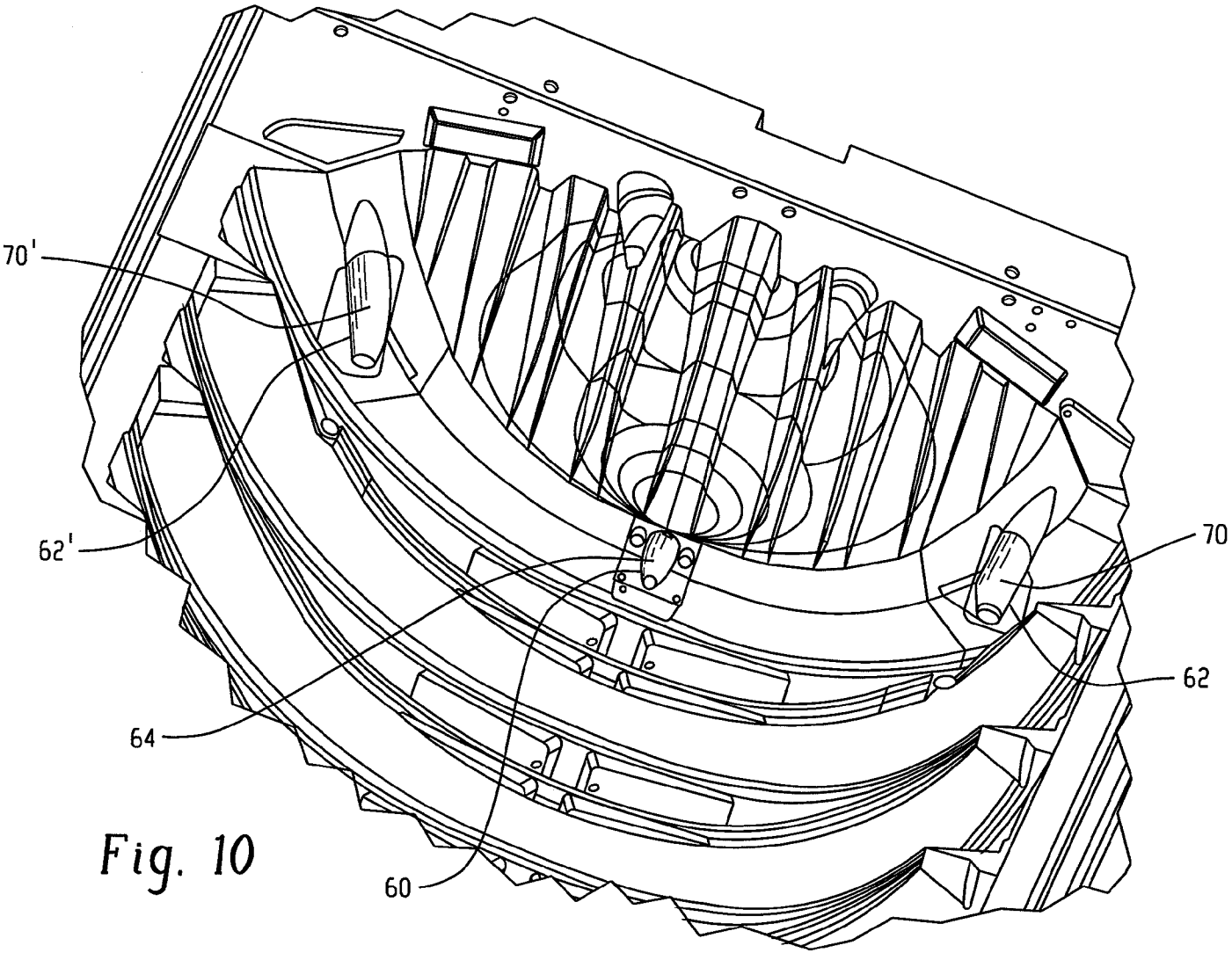
FIG. 10 shows a partial perspective of a mold tool cavity part having inserts from FIGS. 8 and 9 located therein.
Figure 11:
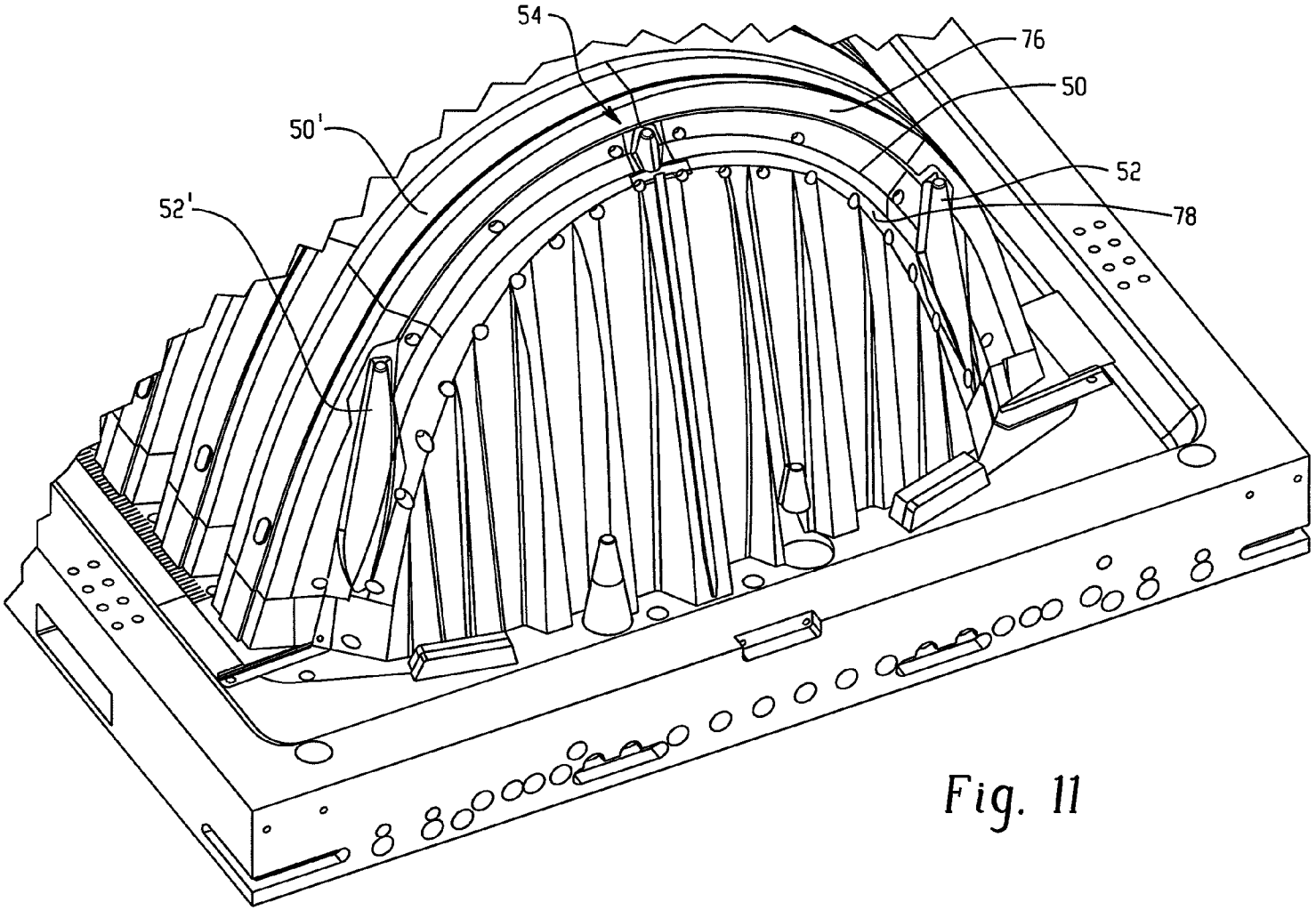
FIG. 11 shows a partial perspective of a mold tool core part having inserts from FIG. 7 located therein.

Referring to the schematics of FIGS. 5 and 6, different installation options are described. In both cases, a given row of chambers are connected together end to end to form a continuous, elongated chamber row. The row is formed by respective unitary end wall chambers 10 at the ends, but facing opposite directions, with any number of open-ended chambers 12 positioned therebetween. However, a row might also be formed by just two unitary end wall chambers without any intervening open-ended chambers. Moving from left to right, the smaller end corrugation of 30 of the left end chamber is overlapped by a end corrugation 34 of the following chamber 12. The small end corrugation of each intermediate chamber is overlapped by the end corrugation of the next following chamber 12 until the right end chamber 10 is reached. In the case of FIG. 5, the chamber 12 adjacent to the right end chamber 10 may be cut at a desired location 40 so that the end corrugation 30 of the right end chamber can be fitted under one of the intermediate corrugations 26 of the adjacent chamber 12. In the case of FIG. 6, the right end chamber 10 can be cut at a desired location 42 so that the end corrugation 30 of the rightmost chamber 12 can be fitted under the intermediate corrugation 26 of the right end chamber 10. In either manner, a continuous row of overlapping chambers of almost any desired length may be formed.

Advantageously, the two different chamber configurations 10 and 12 can be produced by the same mold tool. Specifically, the mold tool is configured to utilize a flow shut off feature within the tooling mold to prevent plastic flow from reaching the end wall space/gap within the closed tool. During molding of an integral end wall chamber 10, plastic is injected into the tool in a manner that facilitates flow into the end wall formation space. During molding of an open-ended chamber 12, the mold is fitted with structure that prevents flow into the end wall formation space and plastic and gas injection may also be modified. In one example, different mold core and mold cavity inserts are used for formation of the integral end wall chamber 10 verses the open-ended chamber 12.

In this regard, referring to FIGS. 7-11, the inserts, cavity and core are shown for formation of an integral end wall chamber 10. The core includes two mirror image inserts 50, 50' that are secured (e.g., using fasteners) to the core along the region of the core that defines where chamber body and end wall will meet. Each insert 50, 50' includes a corresponding sprue flow formation structure 52, 52'. The upper ends of the inserts 50, 50' are structured such that the location where they are positioned adjacent each other is also adapted to provide a sprue formation structure 54. A central insert 60 and side inserts 62, 62' (which are mirror images of each other) are provided for the cavity. The central cavity insert 60 includes a generally frusto-conical recess or cutout 64 which fits over the sprue formation structure 54 when the mold is closed for molding, providing a sprue formation space and flow path there between. The insert 60 also includes an injection opening 66 and flow path 68 leading to the cutout 64 for flowing plastic (or gas) into the mold during molding. The side inserts 62 include respective recesses or cutouts 70 that are configured to align with and be spaced around the sprue formation structure 52 when the mold is closed for molding, providing a sprue formation space and flow path there between. The side insert also includes an opening 72 and flow path 74 leading to the cutout 70 for flowing plastic into the mold during molding. The thickness of the inserts 50, 50' is set such that when the mold is closed, a continuous flow space or gap from the main body side 76 to the end wall side 78 is provided, such that the end wall will be unitary with the main chamber body.

Figure 12:
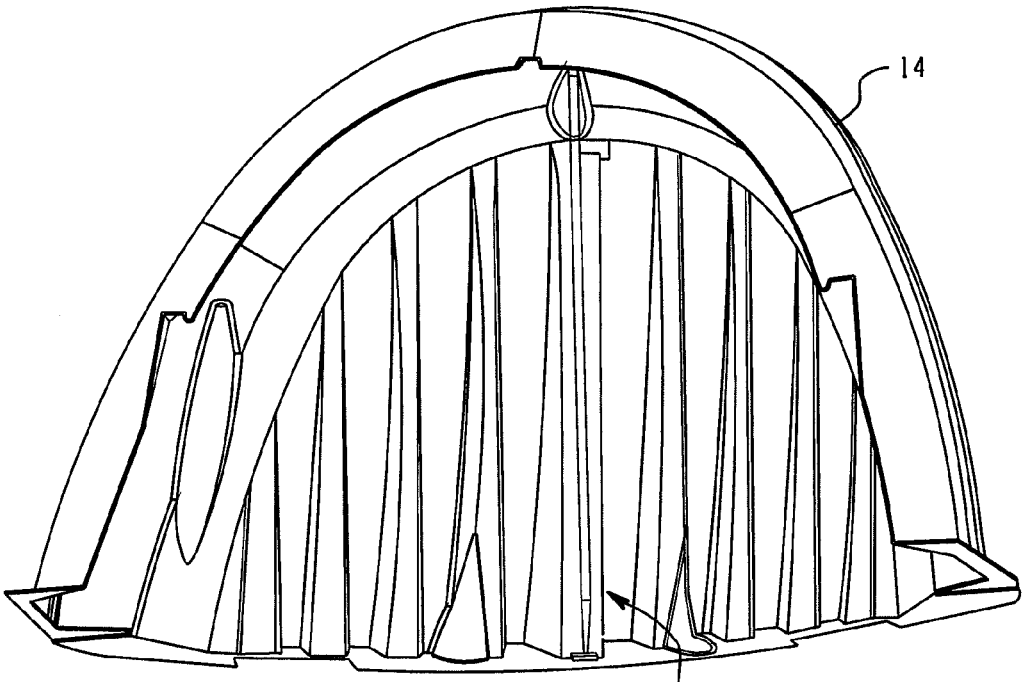
FIG. 12 shows a partial perspective view of the inside of a unitary end wall.
Figure 13:
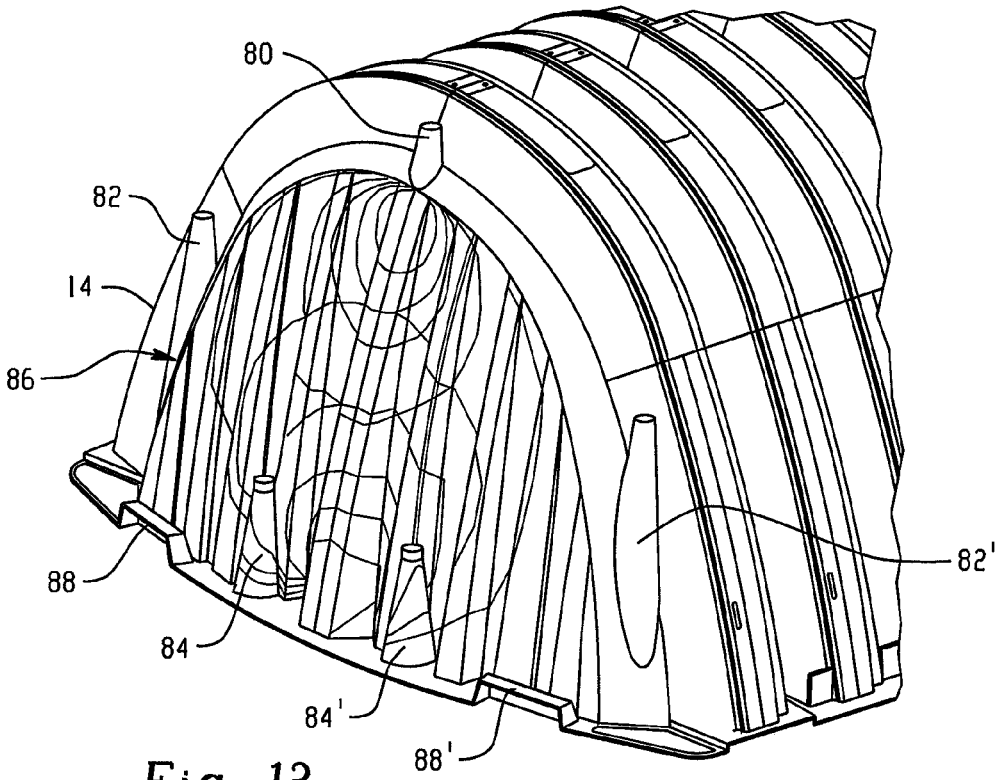
FIG. 13 shows a partial perspective view of the end wall end of a chamber.
Figure 16:
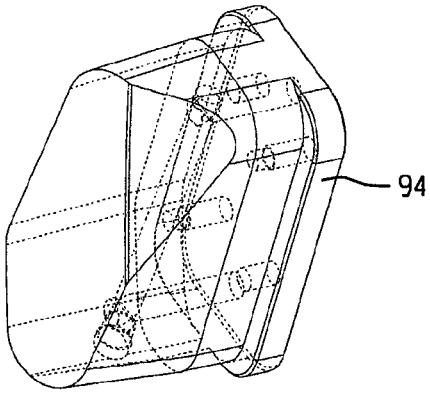
FIGS. 14-16 show mold tool insert embodiments for production of chambers without a unitary end wall.
Figure 15:
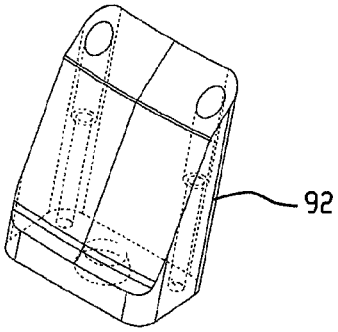
Figure 14:
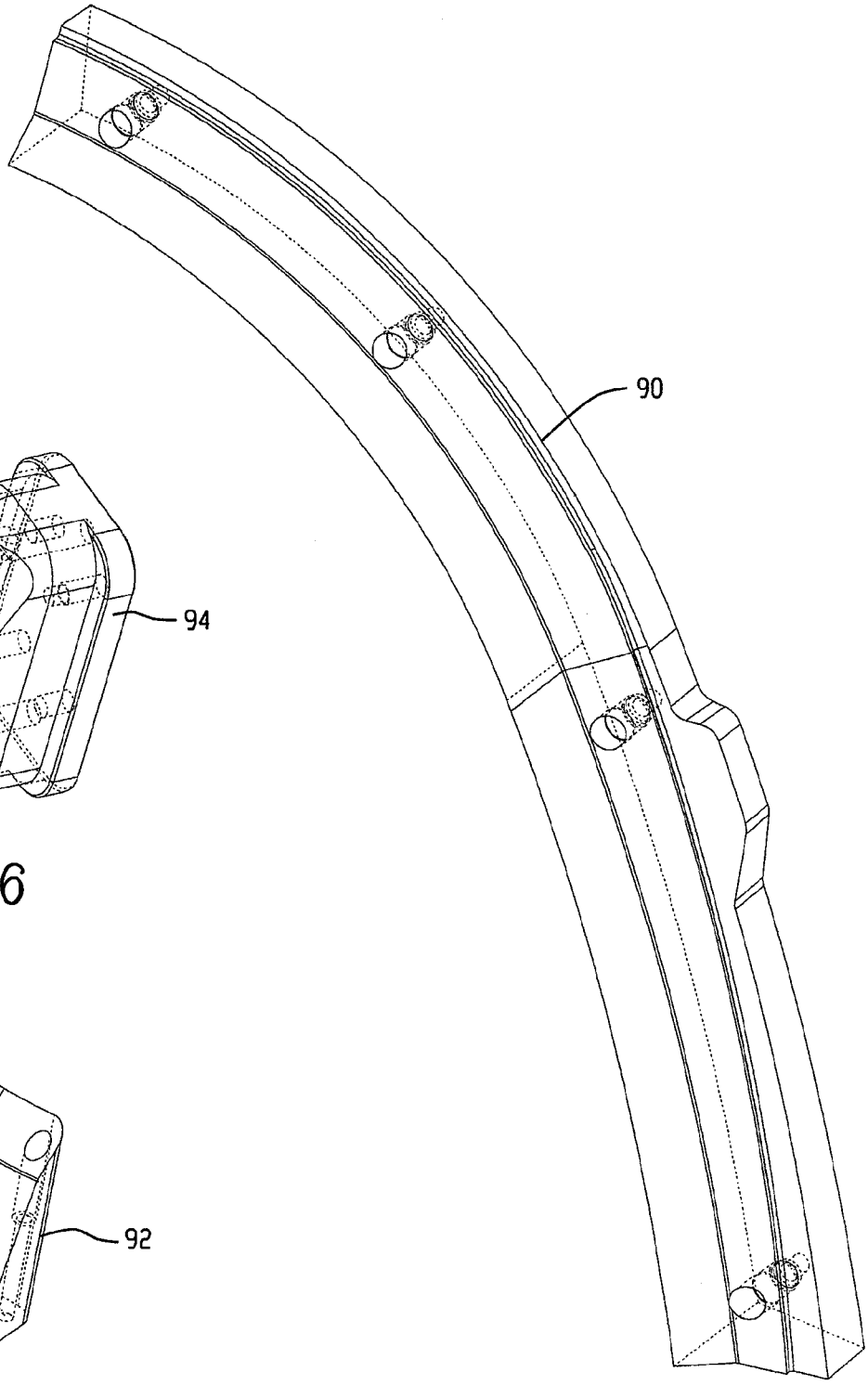
Figure 17:
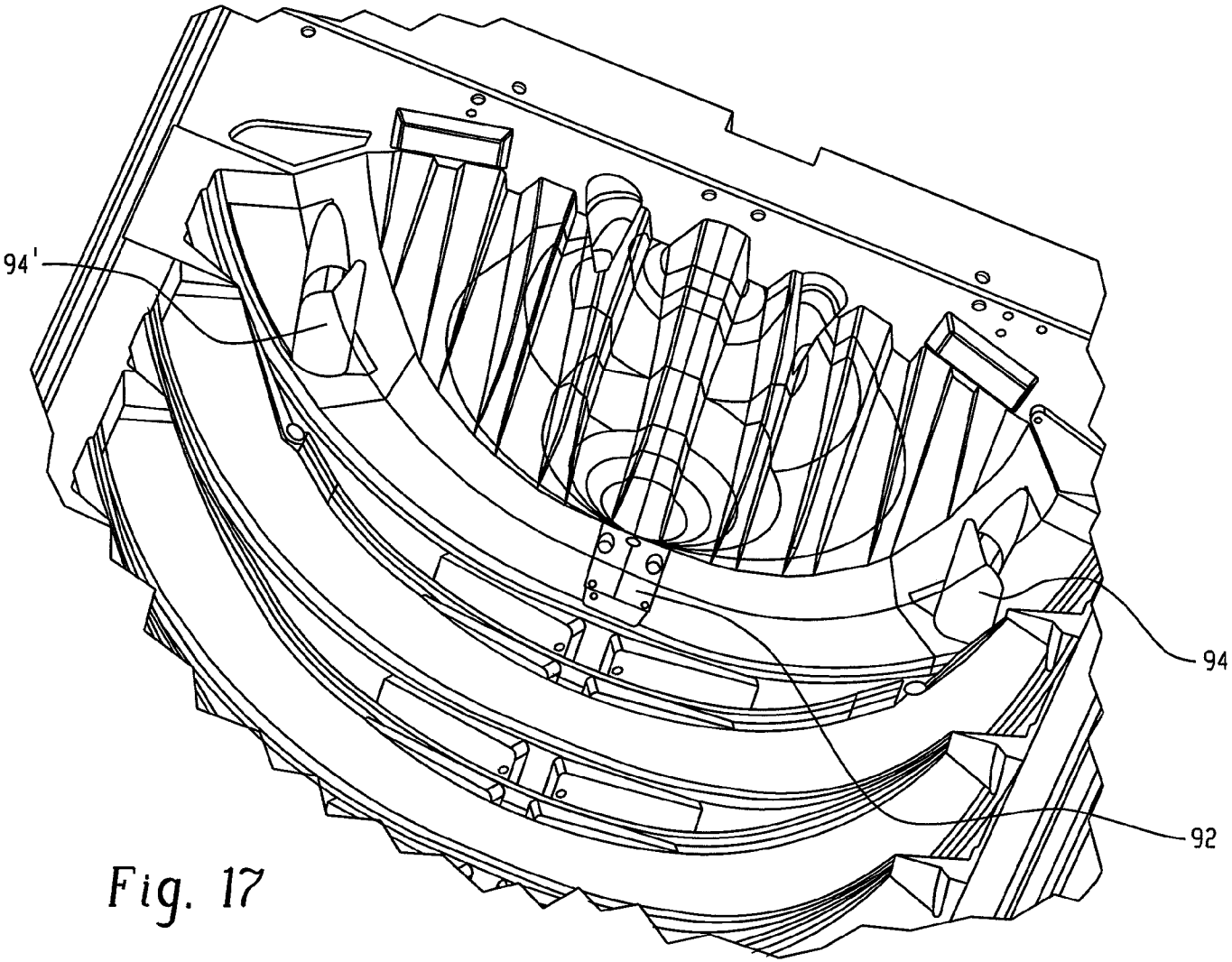
FIG. 17 shows a partial perspective view of the mold tool cavity part with inserts from FIGS. 15 and 16 located therein.
Figure 18:
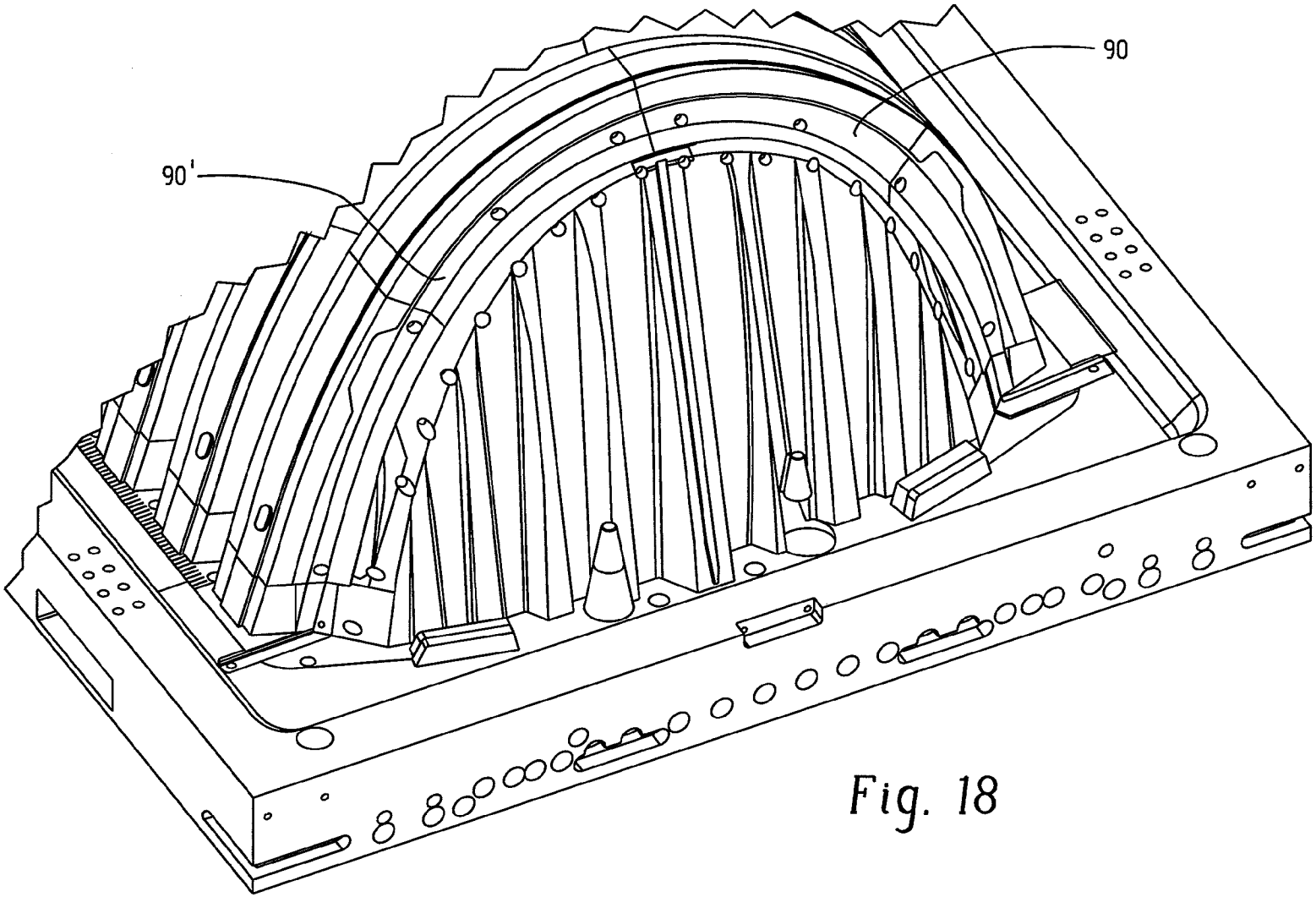
FIG. 18 shows a partial perspective view of the mold too core part with inserts from FIG. 14 located therein.

Referring to FIGS. 12 and 13, the resulting end wall structure is generally shown from inside and outside views respectively, with central sprue 80 and side sprues 82, 82' shown. As shown, the end wall also includes bottom sprues 84, 84', which result from additional plastic injection locations from the mold structure. The end wall 14 also includes vertically extending corrugations 86 for increased end wall strength. Lift handles 88, 88' at the base of the end wall are also provided.

Referring to FIGS. 14-18, the inserts, cavity and core are shown for formation of the open-ended chamber 12. The core includes two mirror image side inserts 90, 90' and the cavity includes a central insert 92 and mirror image side inserts 94, 94'. Inserts 92 and 94, 94' are configured to block or prevent flow from entering through the cavity injection points. The thickness of the inserts 90, 90' is set such that when the mold is closed, the inserts engage with the internal surface of the cavity so that there is no flow space or gap from the main body side 76 to the end wall side 78. Additionally, the mold injection process may be modified to avoid any attempt to inject plastic at end wall locations. In this manner, a chamber without the end wall can be produced.

Figure 19:
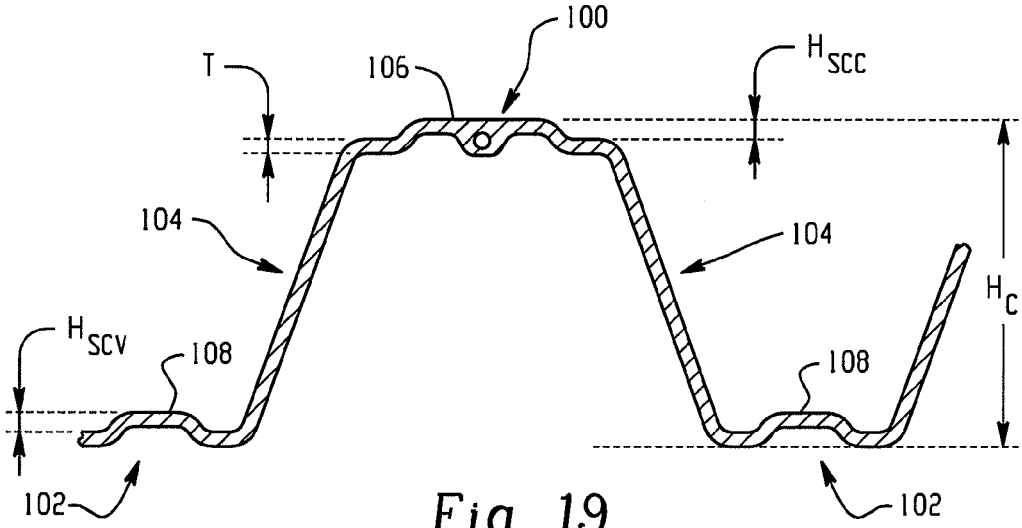
FIG. 19 shows a partial corrugation cross-section illustrating sub-corrugation features.

Referring to FIG. 19, an advantageous corrugation crest and valley profile is shown, with cross-section taken along a plane that runs parallel to the longitudinal axis of the chamber. Specifically, the corrugation crest 100, valleys 102 and webs 104 are illustrated. The corrugation crest 100 includes a central raised sub-corrugation feature 106 and the valleys 102 include a central raised sub-corrugation feature 108. The sub-corrugation features can be used to increase the effective wall properties (area, moment of inertia and section modulus) that in turn increases the chamber wall's load carrying strength, stiffness and moment strength. The sub-corrugations keep more wall material, that otherwise would have been wide flat areas on the crests and in the valleys, structurally functional. Otherwise such areas, being wide and flat, would have a greater tendency to buckle locally under compression strain. It is recognized that the sub-corrugations could alternatively be recessed regions, as opposed to the illustrated raised regions. Moreover, a sub-corrugation feature including one or more raised portions and/or one or more recessed portions could be provided.

In one embodiment, (i) all corrugations crests, with the exception of the crest of smaller end corrugations 30 and 32, include the sub-corrugation feature 106 and (ii) all corrugation valleys, with the exception of the valley immediately adjacent end corrugations 30 and 32 and the valleys immediately adjacent end corrugation 34 include the sub-corrugation feature 108. The illustrated sub-corrugation features are centered on the respective corrugation crests and valleys.

The height, thickness and width of the sub-corrugation features may be established so that the sub-corrugations are stiff enough (e.g., high enough moment of inertia about their horizontal axis) to keep as much of the reaming of the corrugation crest/valley stable in local buckling as practicable when considered in view of added material cost etc. For a substantially fixed sidewall thickness, as a general rule the sub-corrugations can be less deep (shorter height $H_{SCC}$ or $H_{SCV}$) as the crest/valley gets more narrow. The sub-corrugations could also stay the same depth and get more narrow.

With respect to crest sub-corrugation feature 106, in one example the height $H_{SCC}$ of the sub-corrugation feature is less than 10% of the overall height $H_C$ of the corrugation crest (e.g., within a range of about 3-7%), at least along portions of the corrugation crest that extend from the top of the chamber downward to side locations that are at elevations of about ⅓ of the overall chamber height H. The sub-corrugation feature 106 may have a height $H_{SCC}$ that is no more than about three times the thickness T of the plastic defining the corrugation crest (e.g., no more than twice the thickness T or less than 1.25 times the thickness T).

With respect to valley sub-corrugation feature 108, in one example the height $H_{SCV}$ of the sub-corrugation feature is less than 10% of the overall height $H_c$ of the corrugation crest (e.g., within a range of about 3-7%), at least along portions of the corrugation crest that extend from the top of the chamber downward to side locations that are at elevations of about ⅔ of the overall chamber height H. In this regard, and referring to the partial side elevation of FIG. 20, the valley sub-corrugation feature 108 may remain relatively uniform when moving from the top of the chamber downward in elevation until a valley transition height $H_{TV}$ is reached, at which elevation the sub-corrugation feature 108 begins to gradually fade out (e.g., width (relative to side elevation view, where width of the sub-corrugation is measured in the lengthwise axis of direction of the chamber) of the feature decreases and cross-sectional height of the feature decreases) when moving further downward along the chamber sidewall. In one example, the transition height $H_{TV}$ is about ⅔ the overall chamber height H (e.g., between about 55% and 70% of the overall chamber height H). The sub-corrugation feature 108 may have a height $H_{SCV}$ that is no more than about three times the thickness T of the plastic defining the corrugation crest (e.g., no more than twice the thickness T or less than 1.25 times the thickness T).

As an alternative to the sub-corrugation features, an intermediate rib could be provided on the crest and/or in the valley. Placement of suitable gas channels on the crest or in the valley could also provide suitable stability and resistance to global buckling.

Figure 20:
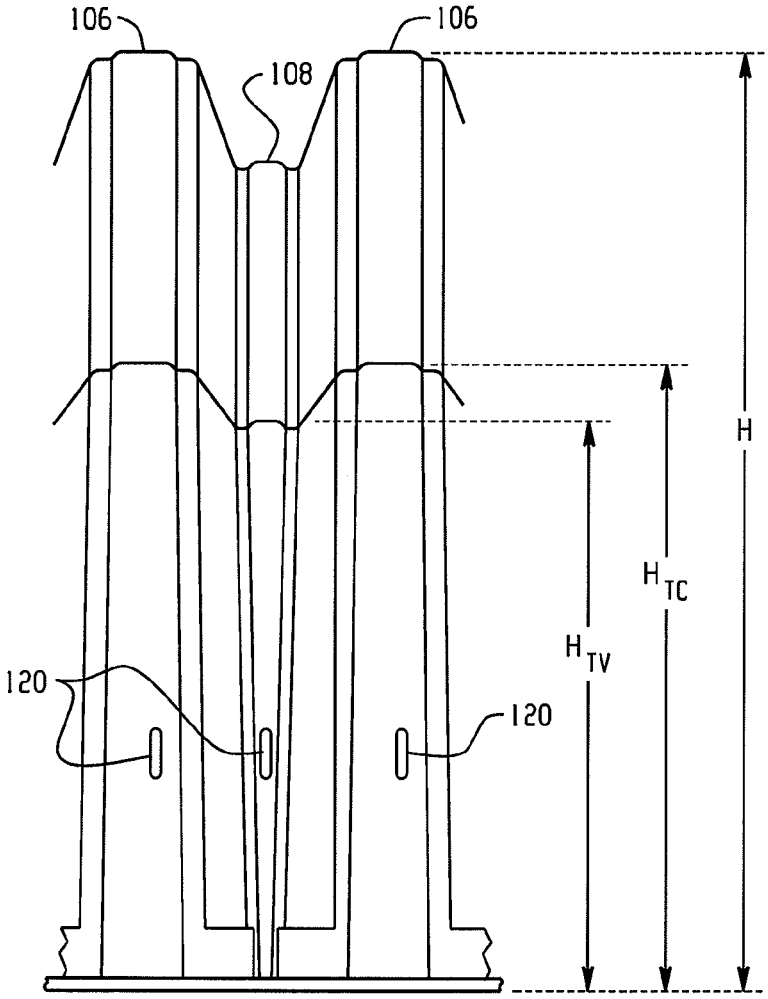
FIG. 20 shows a partial side elevation of a chamber with sub-corrugation features.

As suggested in FIG. 20, the overall width of the corrugation crest may be relatively uniform when moving from the top of the chamber downward to a transition height $H_{TC}$. From that elevation downward the corrugation crest width may increase as shown. This results in a corresponding decrease in the width of the corrugation valley as is also shown. In one example, the transition height $H_{TC}$ is about ⅔ the overall chamber height H (e.g., between about 55% and 75% of the overall chamber height H). A vertically elongated slot 120 is shown on each corrugation crest and valley. A single row of such slots may be provided on each side of the chamber. In another implementation, the width of the corrugation crest may change when moving from the top of the chamber to the bottom of the chamber so as to provide a side elevation view in which the crest width changes constantly with elevation (i.e., for each unit change in elevation there is a constant unit change in crest width). Likewise, the corrugation width where the web meets the valley may also be established so as to provide a side elevation view in which the corrugation base width changes constantly with elevation.

Figure 21:
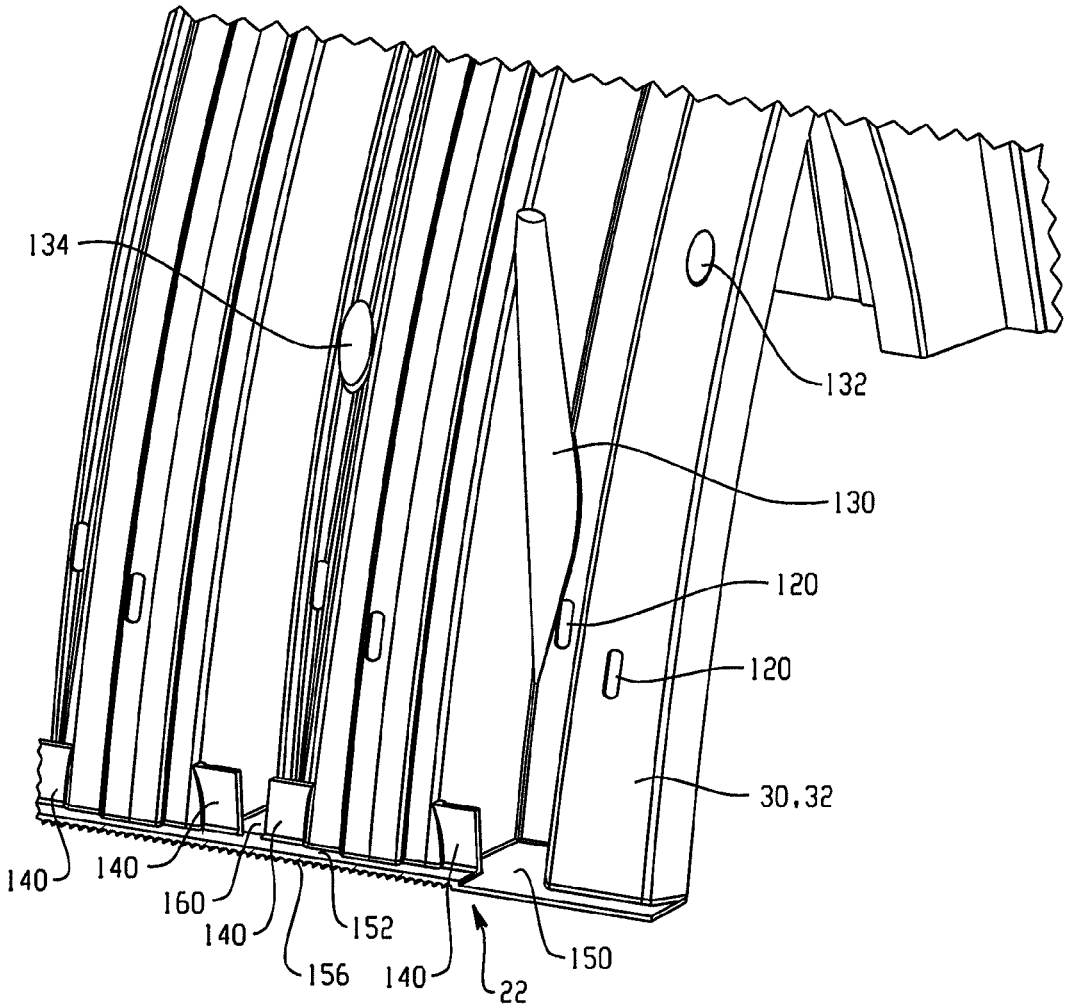
FIG. 21 shows a partial perspective of one side of a chamber and associated foot portion.

Referring to FIG. 21, a partial perspective shows a sprue ledge configuration 130, particularly suited for injection locations that intersect with the webs, and facilitate ease of sprue trimming. Sprue locations that are on corrugation crests can be more easily trimmed to the near flush configurations 132 and 134 as shown.

Also shown in FIG. 21 are stacking blocks or plates 140 that extend outward from the sides of each corrugation crest (with the exception of the small end corrugation 30 or 32 and the opposite end corrugation 34) where the crest meets the foot portion 22. Each stacking plate 140 may extend generally parallel to the longitudinal axis of the chamber. As shown the stacking plate extending from one side of a given corrugation crest extends toward, but does not meet the plate extending from the opposite side of the adjacent corrugation crest, resulting in a gap between the two plates. The stacking plates assist in proper stacking of chambers atop each other in a nested and stable manner for the purpose of chamber transport, with the foot portion of an upper chamber resting on the stacking plate of the chamber immediately below it.

Figure 22:
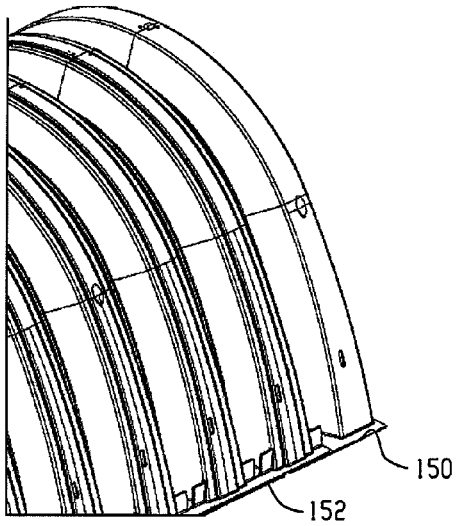
FIGS. 22, 23, 24A, 24B illustrate certain foot portion features according to one embodiment.
Figure 24A:
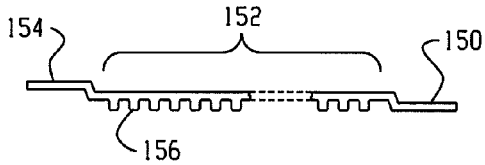
Figure 23:
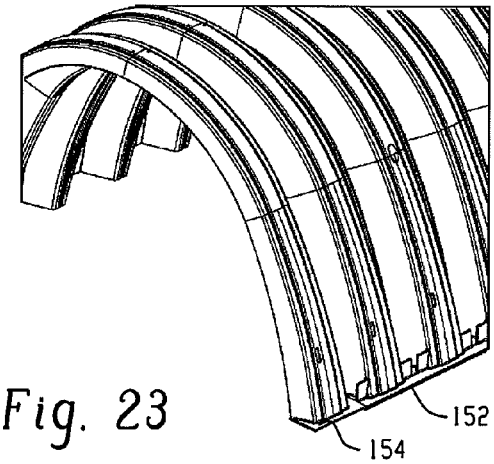
Figure 24B:
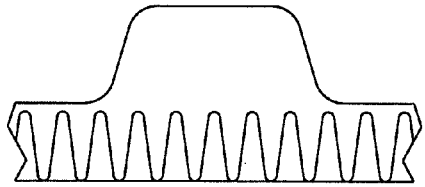

Referring to the foot portion 22 as shown in FIGS. 22 and 23, in the illustrated embodiment the foot portion 22 includes an end part 150 proximate the small end corrugation 30, 32, followed by an intermediate part 152 that extends along the length of the chamber to an opposite end part 154. The end part 150 is generally planar and of uniform thickness and its upper surface is recessed relative to the upper surface of intermediate part 152. The intermediate part has increased thickness with a series of bottom stiffening fingers 156, each of which may extend generally perpendicular to the longitudinal axis of the chamber (though other directions are possible). The end part 154 is generally planar and of uniform thickness and has its bottom surface raised relative to the bottom of intermediate part 152 and end part 150. In this manner, end part 154 will easily accommodate end part 150 beneath it when two chambers are connected by overlapping opposite ends. Referring again to intermediate part 152, the vertical thickness of the stiffening fingers 156 may generally be about the same vertical thickness as the end parts 150 and 154 (though variations are possible). The lateral thickness of the stiffening fingers may be about the same as the vertical thickness (though variations are possible). The spacing between the stiffening fingers can vary, but should generally be selected to provide a projected bearing surface the same as if the bottom surface where planar. This thickness may vary depending upon the sub-base material (e.g., the size of the gravel or stone) upon which the chamber foot portion will rest when installed. By selecting the stiffening finger spacing small enough to prevent the sub-base material from fitting within the spacing, such a projected bearing surface can be maintained. The width and spacing of the fingers also provides stiffness to the foot portion while facilitating efficient moldability by reducing cooling time as compared to a chamber having a foot portion in which the vertical thickness of portion 152 is uniform along its length and the same as the vertical thickness in the region of a finger of the illustrated embodiment.

In one embodiment, the stiffening fingers extend only from the side edges of the side portion toward the corrugation crests and stiffening plates 140, and do not extend into the foot portions 160 (see FIG. 21) that are located between the corrugation crests. In these foot portions 160, the foot material is generally planar on top and bottom, and has a top surface that is recessed relative to the top surface of intermediate part 152 (e.g., similar to the end part 150). Thus, the overall bearing surface of each foot portion is made up of both continuously planar bottom surface portions (e.g., the bottom of end part 150 and foot portions 160) and bottom surface portions that are not continuously planar (e.g., the bottom stiffening fingers of intermediate part 152). Notably however, the bottom surface portions of the stiffening fingers 156 all lie in generally the same plane.

In one implementation, in order to reduce plastic in the chamber, the thickness of each foot portion may be reduced slightly when moving from the corrugation crests outward to the lateral side edge of the foot portion, resulting in a foot portion upper surface that tapers downward slightly when moving from the corrugation crests outward to the lateral side edge of the foot portion.

Figure 2:
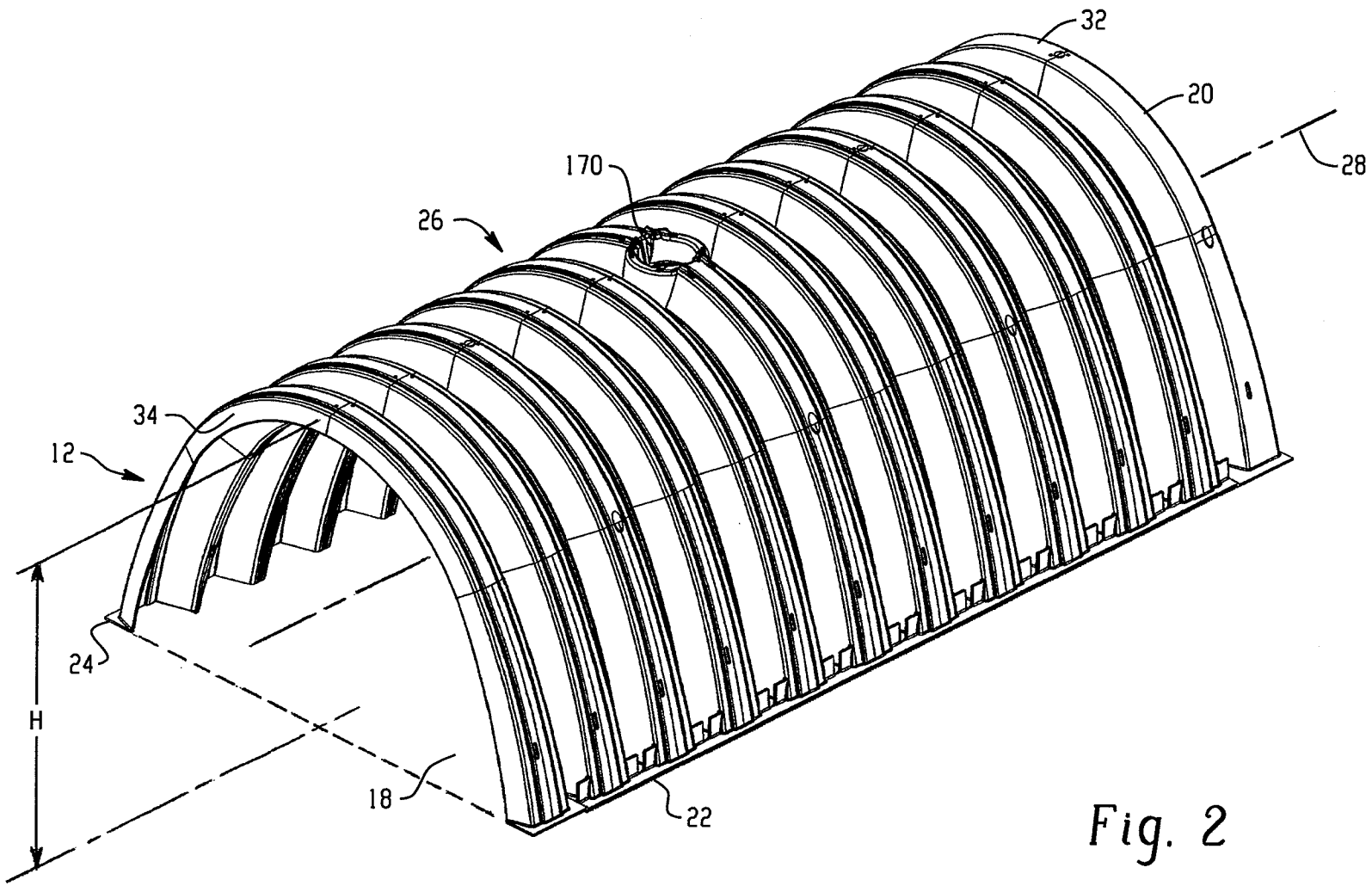
FIG. 2 shows a perspective of one embodiment of a chamber with two open ends.
Figure 3:
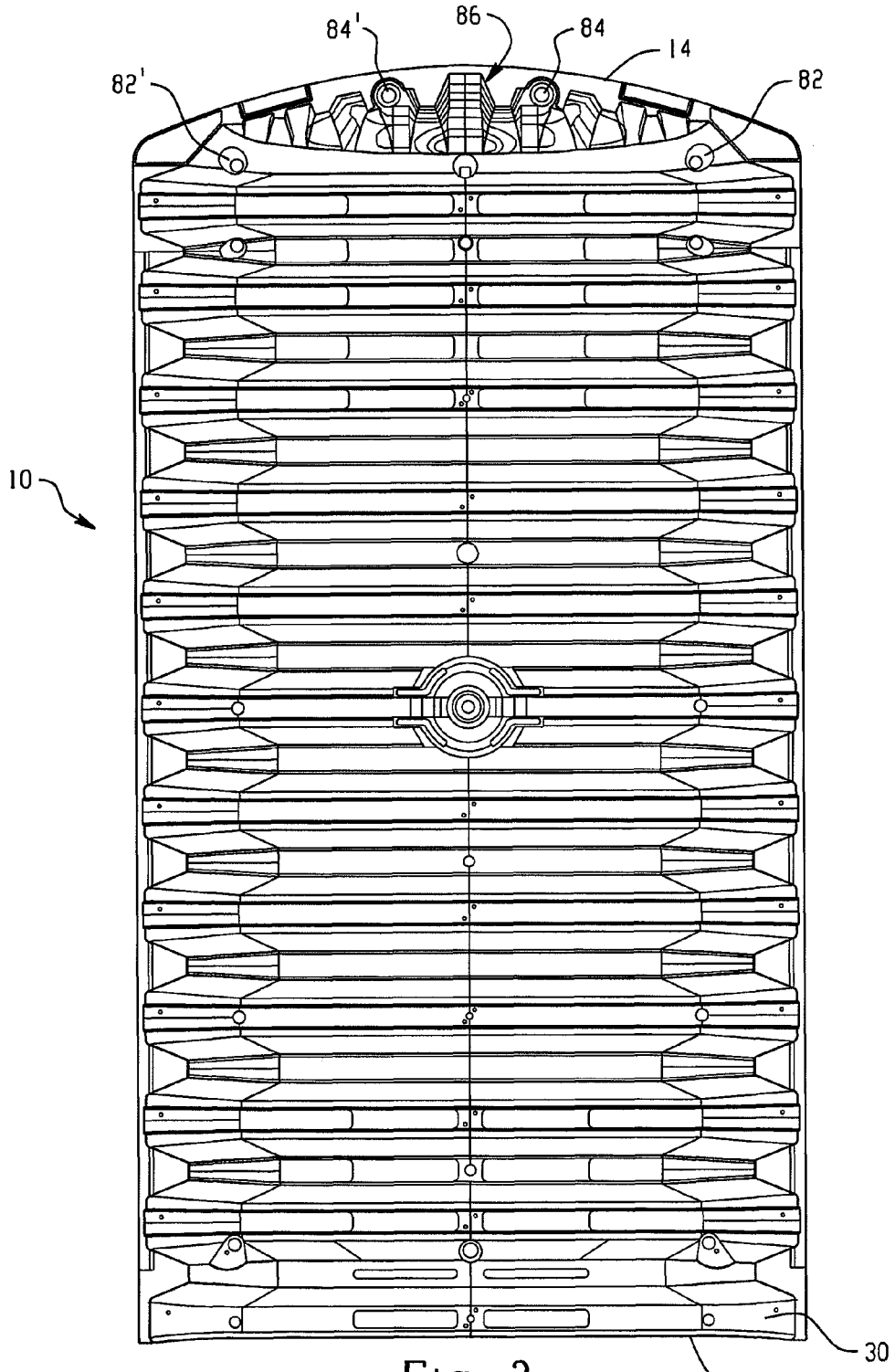
FIG. 3 shows a top plan view of the chamber of FIG. 1.
Figure 4:
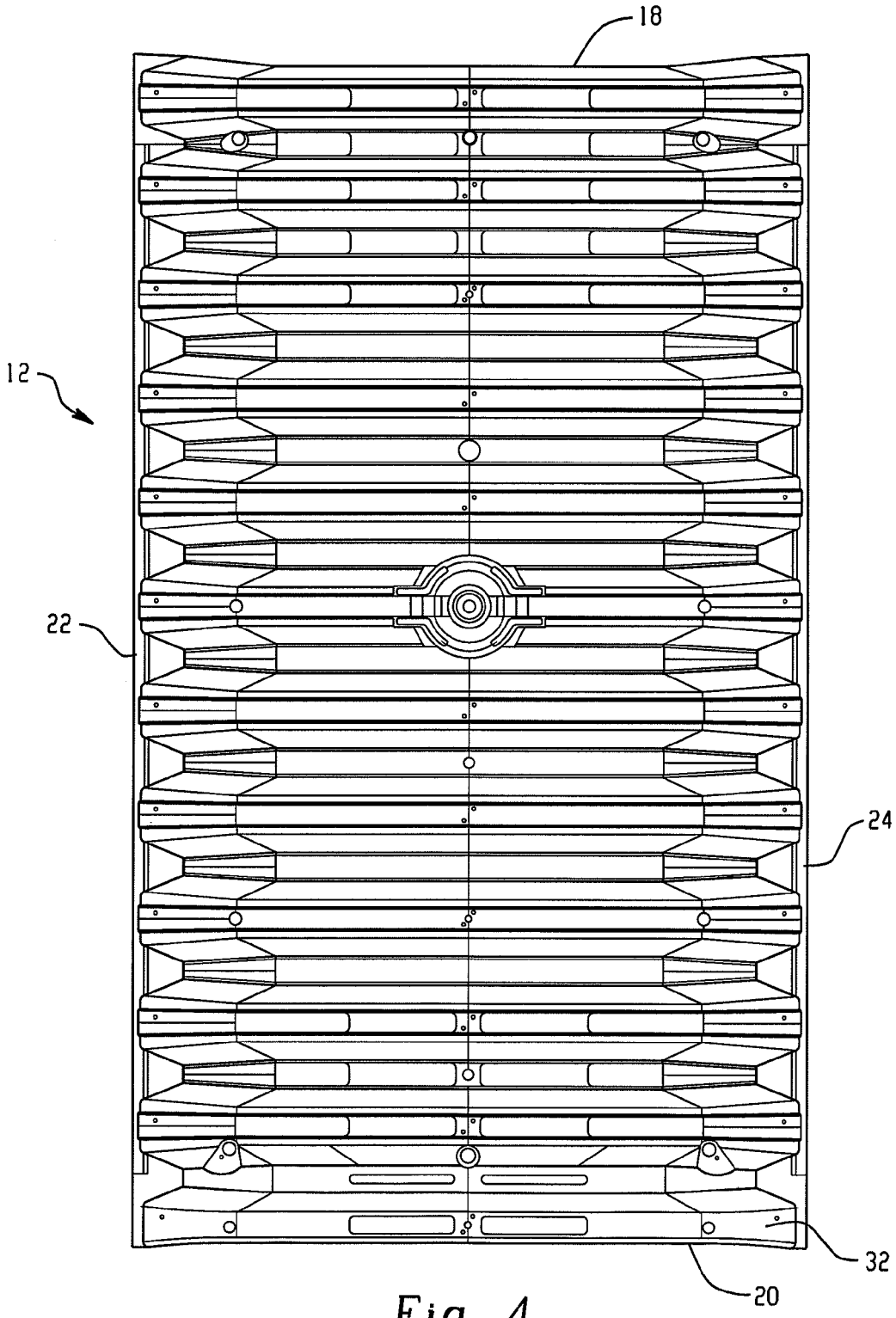
FIG. 4 shows a top plan view of the chamber of FIG. 2.
Figure 25:
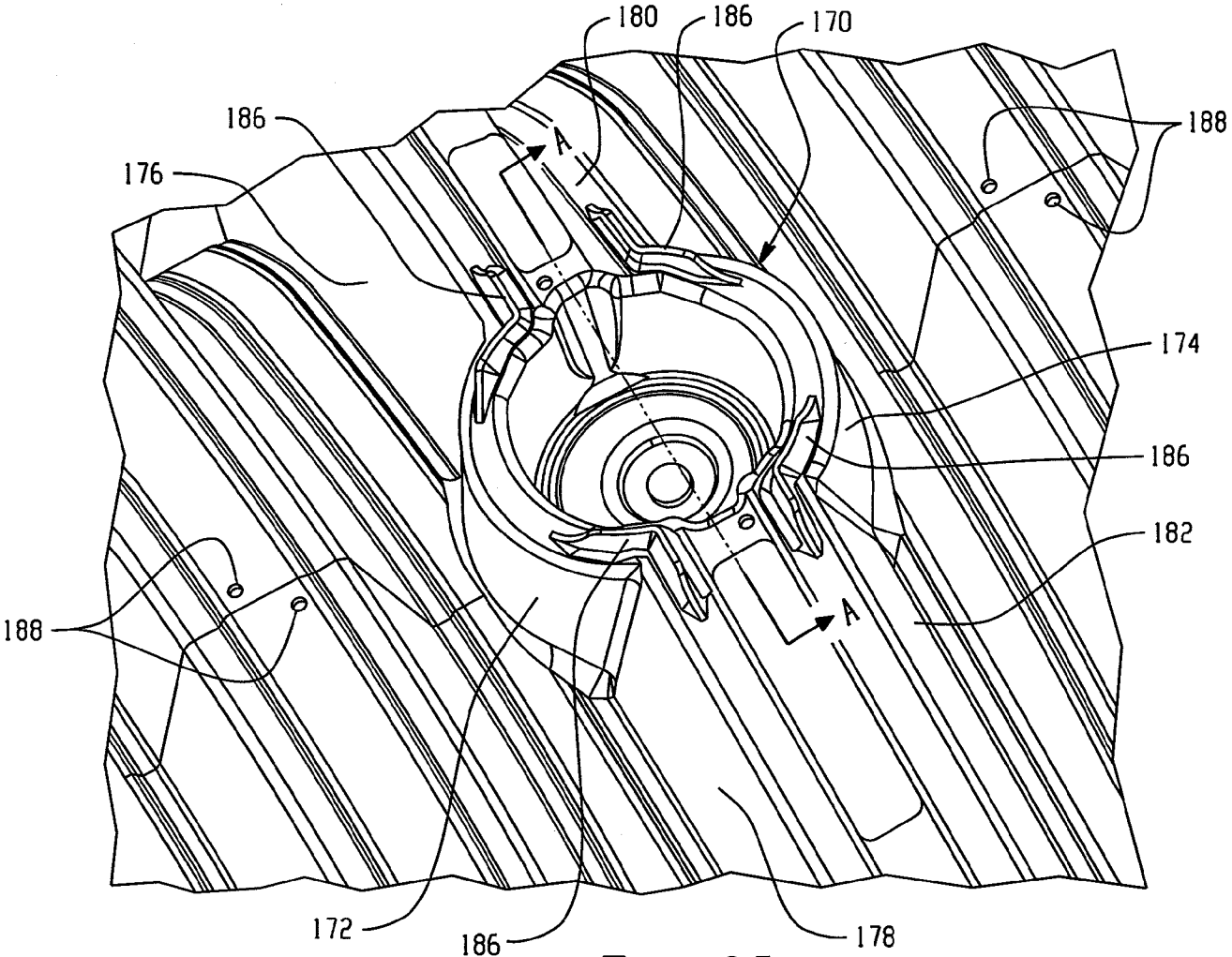
FIG. 25 shows a partial perspective of one embodiment of a chamber viewport.

Referring to FIGS. 2, 25 and 26, the chamber may include one or more viewports (or cleanouts) 170 located atop one or more corrugations. In the illustrated embodiment, a single viewport is provided in one of the corrugations near the longitudinal mid-portion of the chamber. As best seen in FIGS. 25 and 26, where FIG. 26 is a cross-section along line A-A of FIG. 25, the viewport is formed in the corrugation in a manner to maintain cross-sectional properties of the chamber. Specifically, the viewport intersects only a single corrugation crest and its associated webs. Moreover, the outer curved walls 172 and 174 forming the viewport intersect with and provide structural continuity between the webs portions 176, 178 and 180, 182 on opposite sides of the viewport. Raised stiffening ridges 186 may also be provided atop the crest and viewport walls for increased structural integrity, and to establish planar contact with a horizontal flat surface positioned tangent to adjacent corrugation crests, which facilitates distribution of forces into the corrugation with the cutout under parallel plate load testing. Vent holes 188 in the top of the corrugation crests are also shown.

Referring now to the schematic side elevation of another chamber embodiment in FIG. 27 and the end cap view of FIG. 28, an inverted domed end cap could be used to close off the ends of chambers. Such an inverted dome-shaped end cap would operate in membrane tension (instead of bending) in response to forces F exerted on the outwardly facing surface of the cap by the bury material (e.g., soil or gravel). The end cap can therefore be formed thinner, without the need for ribs etc., reducing material usage. Moreover, such an end cap configuration would not be subjected to any direct soil pressure from above. The end cap could be formed with a perimeter structure configured to overlap with part or all of the end corrugation of a chamber.

Referring to FIGS. 1 and 13, the end wall may be formed with circular indicants for facilitating cutting of holes in the end wall to receive multiple specific pipe sizes. In this regard, the indicants may be formed by external raised areas of plastic on the wall. Moreover, upper and lower cutout starting holes could be provided in the end wall to facilitate insertion of a cutting tool in the field for cutting along the indicants. The starting holes could be formed by providing a mold tool in which the mold core part and mold cavity part engage each other in the region where the cutout starting hole is to be provided. In an alternative implementation, the circular indicants could be applied after the fact, as by a printing, painting or screening operation.

It is to be clearly understood that the above description is intended by way of illustration and example only, is not intended to be taken by way of limitation, and that other changes and modifications are possible. Where specific or relative dimensions are provided, such dimensions are not considered limiting unless specifically set forth in any claims.

What is claimed is:

1. An apparatus for receiving and dispersing water, the apparatus comprising:

a plastic arch-shaped corrugated chamber having a generally open bottom and including a plurality of corrugation crests and a plurality of corrugation valleys distributed along a length of the chamber, the corrugation crests and corrugation valleys extending transverse to a lengthwise axis of the chamber, wherein multiple corrugation valleys include a respective valley sub-corrugation feature thereon, where each corrugation valley is defined by a respective inner surface and a respective outer surface, and the valley sub-corrugation feature offsets both the inner surface and the outer surface in a common raised or recessed orientation in the region of the valley sub-corrugation;

each valley sub-corrugation feature (i) is an external raised sub-corrugation located along at least a top portion of its respective corrugation valley, (ii) extends downward toward the bottom of the chamber on opposite sides of the chamber, (iii) has an upper portion with substantially uniform width and (iv) has lower portions on opposite sides of the chamber, each lower portion decreasing in width as it moves downward.

2. The apparatus of claim 1 wherein multiple corrugation crests include a respective crest sub-corrugation feature thereon.

3. The apparatus of claim 2 wherein each crest sub-corrugation feature comprises an external raised sub-corrugation feature with inner surface portion raised outward and outer surface portion raised outward and each valley sub-corrugation feature comprises an external raised sub-corrugation feature with inner surface portion offset outward and outer surface portion offset outward.

4. The apparatus of claim 3 wherein:

the corrugation crests and corrugation valleys extend from side to side of the chamber between spaced apart lengthwise extending foot portions of the chamber, wherein each foot portion includes a bottom portion with a plurality of downwardly facing stiffening fingers.

5. The apparatus of claim 4 wherein:

each foot portion includes first and second end parts at opposite lengthwise ends of the chamber, and an intermediate part between the first and second end parts, the stiffening fingers are located on the intermediate part, bottom surfaces of the first and second end parts are substantially planar.

6. The apparatus of claim 5 wherein:

at least one viewport structure is provided on the chamber, the viewport structure configured to intersect only a single corrugation crest.

7. The apparatus of claim 6 wherein:

the single corrugation crest connects to adjacent corrugation valleys via respective opposed webs, the viewport structure includes outer curved wall portions, each outer curved wall portion intersects and provides structural continuity between respective portions of one of the opposed webs.

8. The apparatus of claim 2 wherein each crest sub-corrugation feature is substantially centered along a width of its respective corrugation crest, each valley sub-corrugation feature is substantially centered along a width of its respective corrugation valley.

9. The apparatus of claim 8 wherein:

each crest sub-corrugation feature is located along at least a top portion of its respective crest, each crest sub-corrugation feature has a crest sub-corrugation height, relative to its corrugation crest, that is less than 10% of a height of the corrugation crest relative to its adjacent corrugation valley, each valley sub-corrugation feature is located along at least a top portion of its respective valley, each valley sub-corrugation feature has a valley sub-corrugation height, relative to its corrugation valley, that is less than 10% of a height of the adjacent corrugation crest relative to the corrugation valley.

10. The apparatus of claim 9 wherein:

a width of each of the multiple corrugation crests is greater toward the bottom of the chamber than at a top of the chamber, a width of each crest sub-corrugation feature is greater toward the bottom of the chamber than at the top of the chamber, a width of each of the multiple corrugation valleys is less toward the bottom of the chamber than at the top of the chamber, a width of each valley sub-corrugation feature is less toward the bottom of the chamber than at the top of the chamber.

11. The apparatus of claim 2 wherein:

each crest sub-corrugation feature is located along at least a top portion of its respective corrugation crest, each crest sub-corrugation feature has a crest sub-corrugation height, relative to its corrugation crest, that is no more than about three times a thickness of the plastic defining the corrugation crest, each valley sub-corrugation feature is located along at least a top portion of its respective corrugation valley, each valley sub-corrugation feature has a valley sub-corrugation height, relative to its corrugation valley, that is no more than about three times a thickness of the plastic defining the corrugation valley.

12. The apparatus of claim 2 wherein:

each crest sub-corrugation feature is located along at least a top portion of its respective corrugation crest, each crest sub-corrugation feature has a crest sub-corrugation height, relative to its corrugation crest, that is no more than about three times a thickness of the plastic defining the corrugation crest.

13. The apparatus of claim 2 wherein:

each crest sub-corrugation feature has at least one opening therein, the opening located toward the bottom of the chamber and offset toward one side of the sub-corrugation feature.

14. The apparatus of claim 1 wherein:

multiple corrugation crests include a respective crest sub-corrugation feature thereon;

a width of each of the multiple corrugation crests is greater toward the bottom of the chamber than at a top of the chamber, a width of each crest sub-corrugation feature is greater toward the bottom of the chamber than higher along the chamber.

15. An apparatus for receiving and dispersing water, the apparatus comprising:

a plastic arch-shaped corrugated chamber having a generally open bottom and including a plurality of corrugation crests and valleys distributed along a length of the chamber, the corrugation crests and valleys extending transverse to a lengthwise axis of the chamber, wherein at least one viewport structure is provided on the chamber, the viewport structure configured to intersect only a single corrugation crest, the single corrugation crest connects to adjacent corrugation valleys via respective opposed webs, the viewport structure includes outer curved wall portions, each outer curved wall portion intersects and provides structural continuity between respective portions of one of the opposed webs, each curved wall portion includes a top surface that connects with the single corrugation crest at each end of the curved wall portion, each end of the curved wall portion further includes a raised stiffening ridge that extends onto the adjacent portion of the single corrugation crest.

16. An apparatus for receiving and dispersing water, the apparatus comprising:

a plastic arch-shaped corrugated chamber having a generally open bottom and including a plurality of corrugation crests and a plurality of corrugation valleys distributed along a length of the chamber, the corrugation crests and corrugation valleys extending transverse to a lengthwise axis of the chamber, wherein multiple corrugation crests include a respective external raised crest sub-corrugation feature thereon, where each external raised crest sub-corrugation feature is centered along a width of its respective corrugation crest;

a width of each of the multiple corrugation crests is greater toward the bottom of the chamber than at a top of the chamber, a width of each external raised crest sub-corrugation feature is greater toward the bottom of the chamber than higher along the chamber;

a depth of each external raised crest sub-corrugation feature becomes less as the width of its respective corrugation crest narrows, the chamber includes a first end corrugation crest at one chamber end and a second end corrugation crest at an opposite chamber end, each of the first and second end corrugation crests lacks any sub-corrugation feature.

17. The apparatus of claim 16 wherein:

multiple corrugation valleys include the respective sub-corrugation feature thereon in the form of an external raised valley sub-corrugation feature that (i) is located along at least a top portion of its respective corrugation valley, (ii) extends downward along opposite sides of the chamber and (iii) has lower portions on opposite sides of the chamber, each lower portion decreasing in width as it moves downward.

* * * * *